US005624322A

United States Patent [19]

Riley

[11] Patent Number: 5,624,322

[45] Date of Patent: Apr. 29, 1997

[54] BOWLING ALLEY RETURN AND STORAGE RACK

[75] Inventor: William M. Riley, Richmond, Va.

[73] Assignee: AMF Bowling, Inc., Richmond, Va.

[21] Appl. No.: 636,383

[22] Filed: Apr. 23, 1996

[51] Int. Cl.[6] ..... A63D 5/02

[52] U.S. Cl. ..... 473/54; 473/110

[58] Field of Search ..... 473/54, 73, 106, 473/110, 111, 112, 113

[56] References Cited

U.S. PATENT DOCUMENTS

| | | | |
|---|---|---|---|
| 2,788,972 | 4/1957 | Turner . | |
| 2,937,024 | 5/1960 | Ernst . | |
| 3,071,376 | 1/1963 | Ernst | 473/110 |
| 3,309,085 | 3/1967 | Peplin et al. | 473/110 |

OTHER PUBLICATIONS

C–90 Generation II Ball Return (Advertisement) AMF Bowling, INc., Capital Equipment, P.O. Box 15060, Richmond, VA.

*Primary Examiner*—William M. Pierce

*Attorney, Agent, or Firm*—David E. Dougherty

[57] ABSTRACT

A bowling alley ball return and storage rack includes an infeed track and a pair of parallel generally horizontal storage racks disposed on opposite sides of the infeed track. An S-shaped member acts as a stop for directing a first bowling ball to a first of the storage racks and for positioning the ball therein so that a subsequently returned ball will be deflected by the first ball into the opposite storage rack. The ball return and storage rack includes an infeed track which is generally parallel to and forms a part of the storage racks. This infeed track has a slight downward slope of about 1° from horizontal to bring the bowling balls toward the opposite end thereof. The storage racks also include inner and outer rails, i.e., metallic tubular members which are covered with a nylon 6 coating.

7 Claims, 4 Drawing Sheets

BOWLING ALLEY RETURN AND STORAGE RACK

FIELD OF THE INVENTION

This invention relates to a bowling alley return and storage rack and more particularly to a bowling alley return and storage rack for storing a plurality of bowling balls in a pair of parallel racks in the same generally horizontal plane with the bowling balls being distributed evenly between the two racks.

BACKGROUND OF THE INVENTION

It is common practice in the construction of bowling alleys to provide a bowling alley storage rack at the approach or players end of the alleys, the balls being returned to the rack via a common return runway which extends for the length of the alley. In bowling alley installations of this type, the storage racks are ordinarily designed so that a pair of storage racks are located between two adjacent alleys and extend in the direction of the alleys. The storage racks are also disposed in the same generally horizontal plane at a convenient height, so that a bowler whose turn it is to bowl, approaches the return rack and retrieves his or her bowling ball without bending down more than a moderate amount.

For example, a United States Patent of M. Turner, U.S. Pat. No. 2,788,972 ('972), discloses a bowling alley return terminal unit for holding a substantial number of bowling balls as returned from the pin end of the alley in parallel racks which are in the same horizontal plane. The terminal unit is constructed to receive the bowling balls from a common return way and to cause them, as received, to roll, under gravity, into one or the other of the two parallel ways of the storage unit for easy selection by a bowler when needed. As disclosed in the '972 patent, the terminal unit rack has coextensive, parallel ways which are parallel with the alley for receiving returned bowling balls at the same end and direct from the ball return way, as distinguished from being continuous and in a reverse turn.

A second approach to a bowling ball return and storage rack is disclosed by J. Ernst in his U.S. Pat. No. 2,937,024. As disclosed by Ernst, a bowling ball return and storage rack extends transversely of the alley in such manner that one desiring a ball from the rack would only have to approach the transverse portion from an area behind the bowlers and without encroaching on the playing area, i.e., the approach area of the alley.

The Ernst device incorporates a T-shaped storage rack wherein the storage tracks and the infeed track are arranged generally in the form of a T, so that when the rack is installed, each of the storage tracks will project transversely behind the approach or players portion of a different one of two adjacent alleys between which the infeed track is disposed. The balls which are discharged from the infeed are diverted laterally onto one or the other of the storage racks. In the Ernst device, a switch member directs a bowling ball to one or the other of the storage racks on a random basis. However, when one of the storage racks is filled with bowling balls, the last ball will be positioned to be lightly engaged by the next ball and the rolling ball will be deflected thereby to the other storage rack.

A more recent approach to a bowling alley ball return and storage rack includes an infeed track and a pair of parallel horizontal storage racks disposed on opposite side of the infeed track. An S-shaped member acts as a stop for directing a first bowling ball to a first of the storage racks and for positioning the ball therein so that a subsequently returned ball will be deflected by the first ball into the opposite storage rack. Such returns included interchangeable rails to compensate for wear. In testing bowling ball return and storage racks of the aforementioned type, it was also found that the returned bowling balls did not always reach the end of the rack and that the bowling alley ball return and storage racks were less durable than desired.

It is now believed that there is a significant demand for an improved bowling ball return and storage rack assembly having a pair of parallel storage racks which are generally parallel with the alley and wherein the returned bowling balls from a single infeed will be evenly distributed to alternate racks. It is also believed that a bowling ball return and storage rack assembly, in accordance with the present invention, will meet that demand and offer a number of other advantages. For example, a bowling ball return and storage rack assembly according to the present invention is of a particularly durable design, has no moving parts and minimizes any maintenance requirements. And, when a bowler picks up a bowling ball from one of the racks, the next returned ball will be automatically directed to the rack which has the lesser number of bowling balls therein.

In addition, the bowling ball return and storage rack assemblies according to the present invention include replaceable wear surfaces. The assemblies also minimize any likelihood of damage to a bowling ball and further reduce the likelihood of a bowling ball falling out of the storage rack or of being inadvertently dislodged therefrom. Finally, the bowling ball return and storage rack assembly, in accordance with the present invention, can be manufactured at a favorable cost and at the same time present a pleasing appearance to a bowler.

BRIEF SUMMARY OF THE INVENTION

In essence, the present invention contemplates a bowling ball return and storage rack for receiving bowling balls from a return runway. The bowling ball return and storage rack comprises an infeed track and a pair of storage racks extending generally parallel to the infeed track and disposed on opposite sides thereof. The storage racks are disposed in a generally horizontal plane adjacent to the infeed track and have a length to accommodate a plurality of bowling balls. Generally, S-shaped stop means are associated with the storage racks for directing a first of the returned bowling balls to a first of the storage racks and each subsequently returned ball to the storage rack having a lesser number of bowling balls therein. And in the event that the racks have an even number of bowling balls therein, the next returning or rolling ball is directed to the first storage rack. Each of the storage racks include a pair of ball supporting surfaces which include a rigid tubular membrane and a plastic covering thereon. In the bowling ball return and storage rack according to the invention, each of the storage racks has a slightly downward slope which braces the bowling balls toward the S-shaped stop means.

The invention will now be described in connection with the accompanying drawings wherein like reference numerals are used to designate like parts.

DETAILED DESCRIPTION OF THE PREFERRED EMBODIMENTS OF THE INVENTION

The following is a detailed description of the best mode presently contemplated for practicing the invention.

A bowling ball return and storage rack assembly in accordance with one embodiment of the invention is shown in FIGS. 1–4. As illustrated therein the bowling ball return and storage rack assembly 10 includes a pair of longitudinally extending rod like members 12 and 14 or metal tubes which form an infeed track. The infeed track is generally horizontal, but includes a slight downward slope to bias the bowling balls toward a forward end 13 of the track and away from a ball lift mechanism at the opposite end of the assembly 10. The downward slope of the infeed track is illuminated schematically in FIG. 7. In the preferred embodiment of the invention, the angle is about 1° but may vary from about one half of 1° to about 2°. The angle may vary dependent on a nylon or other plastic covering which will be described in more detail in connection with FIG. 6.

The infeed track, i.e., rod like members 12 and 14 are disposed adjacent to a conventional ball lift mechanism 16. The ball lift mechanism 16 delivers bowling balls from a runway (not shown) which connects the far end of the alley and the near end or bowlers area. The runway is typically disposed below the level of the alleys, i.e., below a capping member (not shown) which separates a pair of alleys.

Figure 6:
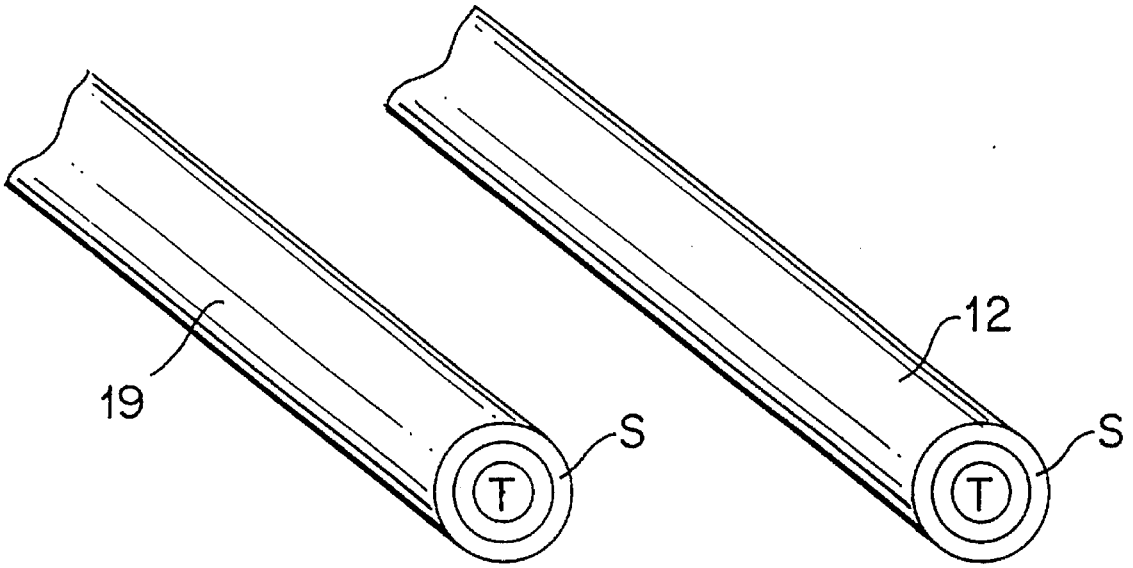
FIG. 6 is a perspective view of a pair of ball supporting surfaces which form a storage rack.
Figure 7:
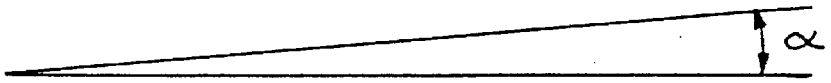
FIG. 7 is a schematic illustration which shows the downward slope of a storage rack.

A pair of generally horizontal storage racks 18 and 20 are disposed parallel with and transversely spaced from the rod-like members 12 and 14. The storage racks 18 and 20 also include a pair of outer rails 19 and 21 which are preferably made of mild steal tubing with a circular cross section. In a preferred embodiment of the invention, these rails are of the same material and are about the same length and diameter as the rod like members 12 and 14. The rails 19 and 21, like the rod-shaped members 12 and 14 are constructed and arranged to be interchangeable so that different portions of each can be used as the wear surfaces. The rails 19 and 21, like members 12 and 14, can for example, be reversed or rotated about their x, y or z axis to provide a new wear surface if one of the rails is damaged by a dropped bowling ball or the like. The rod-like members 12 and outer rail 19 which form ball supporting surfaces are shown in FIG. 6. As shown therein, the rod-like members 12 and outer rail 19 each include a rigid, preferably metal tube T and an outer sleeve S. The rod-like member 14 and outer rail 21 have an identical structure but are not shown in FIG. 6. In a preferred embodiment of the invention, the outer sleeve S is a nylon 6 tube which has an outside diameter of 1.25 inches and an inside diameter of 1.19 inches. This nylon tube is stretched over the metal tube T which has an outside diameter of about 1.25 inches to form a very snug or tight fit. The use of a nylon surface reduces the likelihood of damage to a bowling ball and/or rack in the event of a ball being dropped on the rack. It also tends to slow the ball as the ball rolls toward the end of the rack. It is also believed that the tight fit between the tube T and sleeve S is important for optimal performance.

The outer rails 19 and 21 are parallel to the rod like members 12 and 14, but slightly lower than the infeed track and laterally spaced therefrom by a distance which is slightly less than the diameter of a bowling ball. In this way, the rod like members 12 and 14 serve as the inner rails for the racks 18 and 20.

A decorative cover 24 is pivotally mounted at its lower rear portion to the floor of an alley. The cover 24 encases the ball lift mechanism 16 in a first position as, for example, during bowling. The cover 24 can be readily removed by lifting a forward portion of the cover upwardly and rotating the cover about its pivotal mounting for routine maintenance or other repairs. The cover 24 also defines a generally rectangular opening in its forward portion which allows bowling balls to pass therethrough and onto the infeed track, i.e., members 12 and 14.

In a preferred embodiment of the invention, a bowling ball return and storage rack 10 for receiving bowling balls from a return runway (not shown) comprises a ball lift mechanism 16, a longitudinally extending infeed track including a pair of rails or members 12 and 14 and an end 11 adjacent to the ball lift mechanism 16. A pair of storage racks 18 and 20 include outer rails 19 and 21 which are parallel to the infeed track and disposed on opposite sides thereof. A decorative cover 24 is pivotally mounted to cover and uncover the ball lift mechanism 16 without covering the storage racks 18 or 20.

The storage racks 18 and 20 are disposed in a generally horizontal plane adjacent to the infeed track and have a length which is adequate to accommodate a plurality of bowling balls. First stop means 30, including an S-shaped member 31, is associated with the storage racks 18 and 20 for directing a first of the returned bowling balls to the storage rack 20 and each subsequently returned ball to the storage rack having a lesser number of bowling balls therein and in the event that the racks have an even number of bowling balls therein to the storage rack 20.

Figure 1:
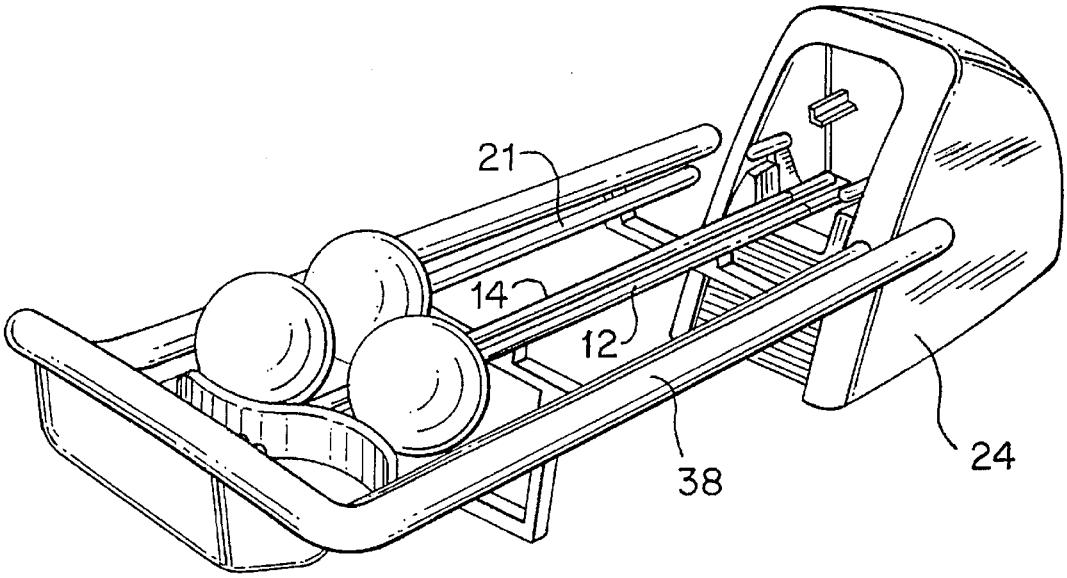
FIG. 1 is a perspective view of a bowling ball return and storage rack assembly in accordance with a preferred embodiment of the invention.
Figure 2:
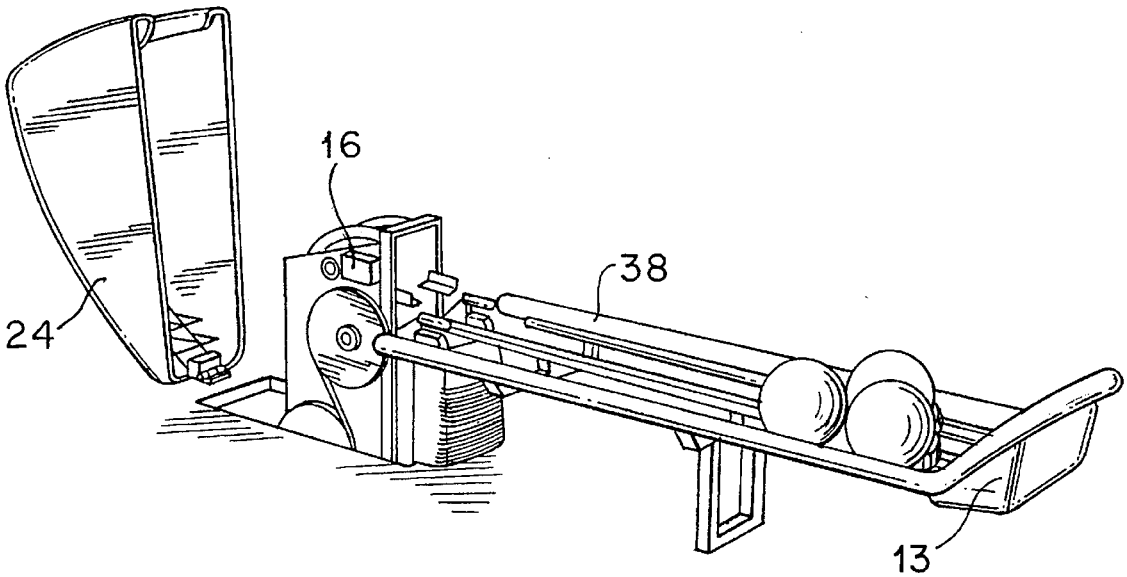
FIG. 2 is a perspective view of the bowling ball return and storage rack in accordance with the preferred embodiment of the invention but with a plurality of bowling balls distributed thereon and with a decorative cover removed to illustrate a ball lift mechanism.
Figure 3:
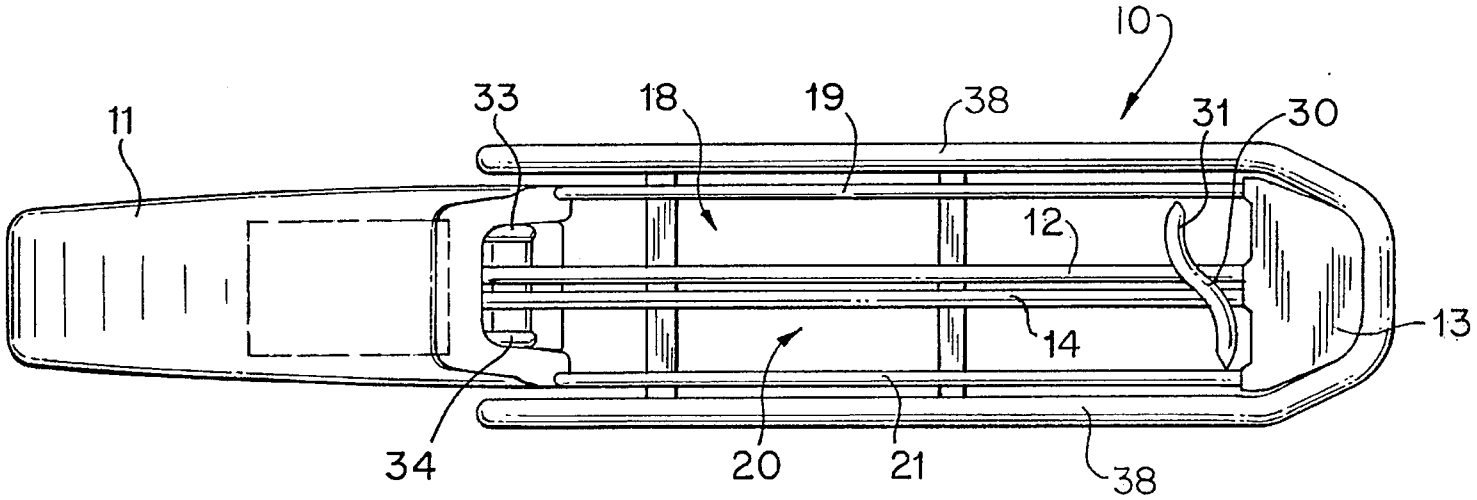
FIG. 3 is a top or plan view of the bowling ball return and storage rack shown in FIGS. 1 and 2.
Figure 4:
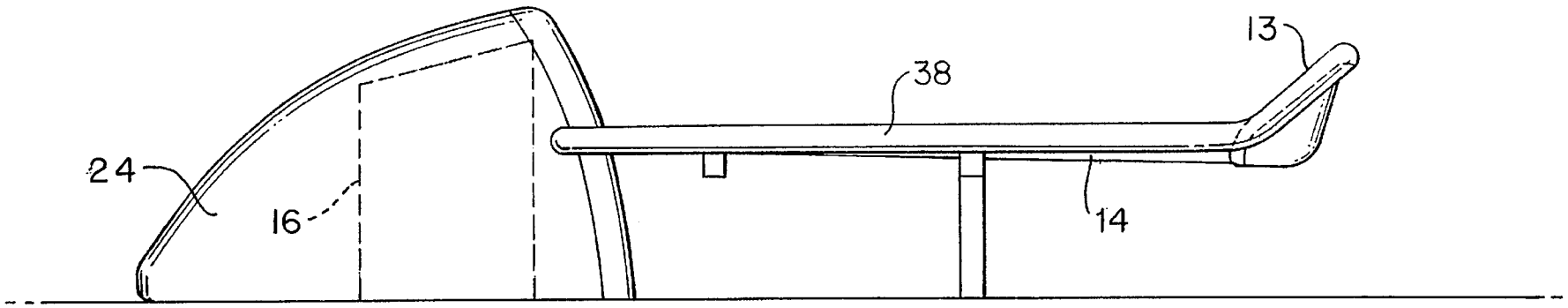
FIG. 4 is a side elevational view of the bowling alley ball return and storage rack shown in FIGS. 1–3.
Figure 5:
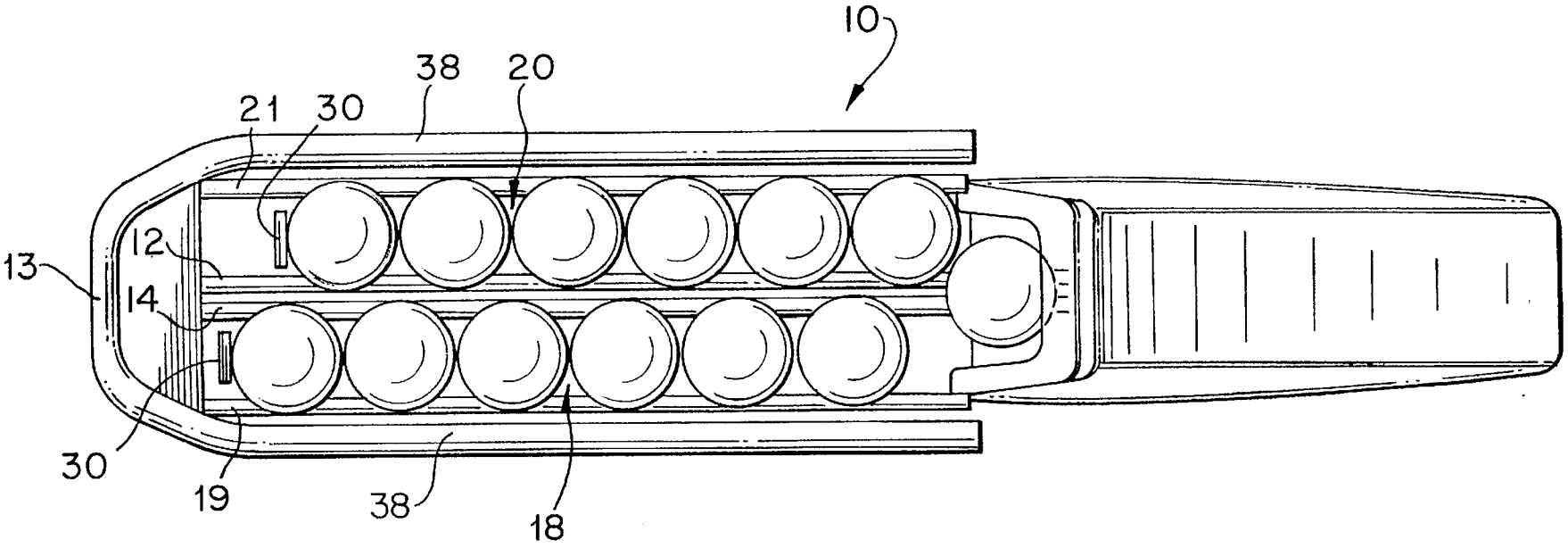
FIG. 5 is a top or plan view of a bowling alley ball return and storage rack in accordance with a second embodiment of the invention.

The stop means 30 may take the form of staggered individual stop members 40 as shown in FIG. 5 or be in the form of an S-shaped member 31 of the preferred embodiment of the invention. In either case a first bowling ball which is delivered to the infeed track, rolls along the length of infeed track and is displaced therefrom by striking a first portion of the S-shaped member 31. That portion deflects the ball into the rack 20. A second portion of the S-shaped member 31 then positions the ball at one end of the storage rack. A second bowling ball then rolls along the infeed track and is deflected into the opposite storage rack 18 when a portion of the ball comes into contact with a portion of the first bowling ball. The second ball is then positioned within storage rack 18 by the first portion of the S-shaped member 31. Since the stop means 30 is staggered by a distance of approximately ½ of the diameter of a bowling ball, subsequent bowling balls will be deflected into the rack which has the lesser number of bowling balls. And, when the racks each have an equal number of bowling balls, the next returned bowling ball will be deflected into the storage rack 20. And then, when a bowler picks up a bowling ball from one of the racks, the next returned ball will be automatically directed to the rack which has the lesser number of bowling balls therein.

A pair of guide members 33 and 34 are provided adjacent to the first end 11 of the infeed track. The guide members 33 and 34 are disposed slightly above the infeed track and between the infeed track and the outer rails of the storage racks for guiding a bowling ball from the ball lift mechanism onto the infeed track and are constructed and arranged to position the decorative cover 24 laterally with respect to the storage racks. The guide members 33 tend to cradle each returned bowling ball and prevent the returned bowling balls from falling to the floor. In a preferred embodiment of the invention, the guide members 33 and 34 comprise short tubular members which can be interchanged, or reversed about a plurality of axis to provide a new surface for contact with a bowling ball. The guide members 33 and 34 also include a generally hemispherical shaped forward bumper which may be made of hard rubber or the like so that when a bowling ball is rolled toward the guide members the bumpers each act as a stop to prevent a ball from striking the ball lift mechanism or from rolling out of the storage rack.

In addition, an outer rail 38 is disposed slightly above the level of the storage racks 18 and 20 and slightly outwardly therefrom. The outer rail 38 extends around the assembly 10 on three sides thereof and protects the bowling balls in storage racks 18 and 20 from being inadvertently bumped or otherwise dislodged or knocked to the floor. The outer rail 38 also serves to prevent a bowling ball which is inadvertently dropped while it is being picked up from falling to the floor.

While the invention has been described in connection with its preferred embodiments, it should be recognized that changes and modifications may be made without departing from the scope of the appended claims.

What is claimed is:

1. A bowling ball storage rack for a ball return for receiving bowling balls from a return runway comprising an infeed track and a pair of storage racks extending generally parallel to said infeed track and disposed on opposite sides thereof, said storage racks disposed in a generally horizontal plane with an infeed track having a slight downward slope from a first end adjacent a return runway and said storage racks having a length to accommodate a plurality of bowling balls, said infeed track including a first pair of rails for transporting a bowling ball along its length, each of said storage racks including an outer rail which is parallel with said first pair of rails, and said first pair of rails of said infeed track serving as inner rails for said storage racks and in which said outer rail of each of said storage racks is disposed slightly below and transversely removed from said first pair of rails by a distance which is less than the diameter of a bowling ball, each of said rails comprising a rigid tubular member and a plastic covering thereon, and stop means disposed at a second end of said infeed track which is the end opposite to the return runway for directing a first of a returned bowling ball to a first of said storage racks and causing each subsequently returned ball to contact a previous ball in order to direct the subsequent ball to the storage rack having a lesser number of bowling balls therein or in the event that the racks have an even number of bowling balls therein, to said first rack.

2. A bowling ball storage rack for a ball return for receiving bowling balls from a return runway in accordance with claim 1, in which said stop means includes a generally S-shaped member and in which a first portion of said S-shaped member forms a stop at one end of a first of said storage racks and in which a second portion of said S-shaped member forms a stop at one end of said second of said storage racks.

3. A bowling ball storage rack for a ball return for receiving bowling balls from a return runway in accordance with claim 2, in which said first pair of rails and said outer rails are made of steel tubing with a generally circular cross section and in which said plastic covering is a tube of nylon-6 compound which is tightly adhered to said steel tubing.

4. A bowling ball storage rack for a ball return for receiving bowling balls from a return runway in accordance with claim 3, wherein the downward slope of said infeed track is about 1° from horizontal.

5. A bowling ball storage rack for a ball return for receiving bowling balls from a return runway in accordance with claim 4, which includes a pair of guide members adjacent to a first end of said infeed track for guiding a bowling ball from a ball lift mechanism, said guide members being positioned above said infeed track and between the rails of said infeed track and the outer rails of said storage racks.

6. The combination of a bowling ball storage rack for a ball return for receiving bowling balls from a return runway and a ball lift, said storage rack further comprising a longitudinally extending infeed track including a first a first pair of tubular rails and having a first end adjacent to said ball lift, and a pair of storage racks each including an outer rail which is parallel to said infeed track and disposed on an opposite side thereof, a decorative cover having a means to pivotally mount the cover to cover and uncover said ball lift without covering said storage racks, the storage racks disposed in a generally horizontal plane with said infeed track which has a slight downward slope of about 1° from horizontal and said storage racks having a length to accommodate a plurality of bowling balls, wherein said first pair of rails are for transporting a bowling ball along its length and serving as inner rails for said storage racks, further said outer rail of each of said storage racks is disposed slightly below and transversely removed from said first pair of rails by a distance which is less than the diameter of a bowling ball, each of said rails comprising a rigid metallic tubular member with a circular cross section and a nylon sleeve surrounding said tubular member, a generally S-shaped stop member in which a first portion of said S-shaped member forms a stop at one end of a first of said storage racks and in which a second portion of said S-shaped member forms a stop at one end of said second of said storage racks.

7. The combination of a bowling ball storage rack for a ball return for receiving bowling balls from a return runway and a ball lift, in accordance with claim 6 in which said nylon sleeve has an outside diameter of about 1.25 inches and a wall thickness of about 0.060 inches.

* * * * *